US007845920B2

(12) United States Patent
Kondo et al.

(10) Patent No.: US 7,845,920 B2
(45) Date of Patent: Dec. 7, 2010

(54) OIL PUMP

(75) Inventors: Takashi Kondo, Saitama-ken (JP); Kazuhiko Iso, Saitama-ken (JP); Yojiro Koiwa, Saitama-ken (JP); Yasunori Ono, Gunma-ken (JP); Atsushi Yanagisawa, Gunma-ken (JP); Atsushi Kaneko, Gunma-ken (JP)

(73) Assignees: Honda Motor Co., Ltd., Tokyo (JP); Yamada Manufacturing Co., Ltd., Kiryu-shi, Gunma-ken (JP)

( * ) Notice: Subject to any disclaimer, the term of this patent is extended or adjusted under 35 U.S.C. 154(b) by 935 days.

(21) Appl. No.: 11/723,169

(22) Filed: Mar. 16, 2007

(65) Prior Publication Data

US 2007/0224053 A1 Sep. 27, 2007

(30) Foreign Application Priority Data

Mar. 24, 2006 (JP) ..... 2006-084277

(51) Int. Cl.
*F03C 2/00* (2006.01)
*F04B 11/00* (2006.01)

(52) U.S. Cl. ..... 418/61.3; 418/2; 418/19; 418/166; 418/177; 417/540; 138/26

(58) Field of Classification Search ..... 418/61.3, 418/2, 19, 166, 171; 417/540, 312, 542; 138/26

See application file for complete search history.

(56) References Cited

U.S. PATENT DOCUMENTS 3,061,039 A * 10/1962 Peters ..... 138/26
4,264,287 A * 4/1981 Ishida et al. ..... 417/540
6,752,604 B2 * 6/2004 Althouse ..... 418/2
6,776,589 B2 * 8/2004 Tomell et al. ..... 417/415
7,361,002 B2 4/2008 Ohnishi et al.
7,392,780 B2 * 7/2008 Tsuruta et al. ..... 123/196 CP

FOREIGN PATENT DOCUMENTS

| | | | |
|---|---|---|---|
| GB | 2036873 A | * | 7/1980 |
| GB | 2 319 564 A | | 5/1998 |
| GB | 2319564 A | * | 5/1998 |
| JP | 6-165818 | | 6/1994 |
| JP | 2003-184523 | | 7/2003 |
| JP | 2005-146995 | | 6/2005 |
| JP | 2005-146998 | | 6/2005 |
| WO | WO99/56052 | | 11/1999 |

* cited by examiner

*Primary Examiner*—Thomas E Denion
*Assistant Examiner*—Mary A Davis
(74) *Attorney, Agent, or Firm*—McGinn IP Law Group, PLLC

(57) ABSTRACT

An oil pump in which pulsation vibration due to the dynamic pressure on the discharge port side can be attenuated. In an oil pump for transporting fluid from a suction port to a discharge port by the rotation of a rotor mounted in a pump casing, a resonator configured from an introduction path and a chamber is formed with respect to a discharge flow channel that communicates with the discharge port in the flow direction of the discharge flow channel. A channel in a direction different to the flow direction of the discharge flow channel is communicatingly formed in the vicinity of the resonator.

5 Claims, 7 Drawing Sheets

5
5a
5b
5c
6
7
61
61a
62
S 5
5a
5c
7
61
S
61a
5b
62
6

OIL PUMP

BACKGROUND OF THE INVENTION

1. Field of the Invention

The present invention relates to an oil pump in which pulsation vibration due to dynamic pressure on the discharge port side can be attenuated.

2. Description of the Related Art

Japanese Patent Application Laid-open No. 2005-146998 discloses an oil pump comprising a torocoid-toothed or similar rotor for attenuating the vibration and so on due to pulsation on the discharge port side thereof. Japanese Patent Application Laid-open No. 2005-146998 discloses the provision in a part of the discharge port of a throttle of reduced cross-sectional area. The application also discloses the provision in the vicinity of the discharge port in the downstream side thereof of an oil chamber that communicates with the discharge port by way of the throttle.

The oil chamber communicates with the discharge port by way of a narrow communication hole that communicates in the vertical direction with a flow channel of the discharge port, is formed in a rectangular shape extending in parallel with a linear section of the flow channel of the discharge port, and is arranged sidelong in parallel with the discharge port. In this way, Japanese Patent Application Laid-open No. 2005-146998 discloses an oil chamber of a configuration in which a narrow communication hole is provided in the vertical direction with the discharge port to afford communication therewith.

As is disclosed in Japanese Patent Application Laid-open No. 2005-146998, the oil chamber is provided in parallel and in a juxtaposed state with a linear flow channel of the discharge port. A communication hole (oil inflow port) by which the oil chamber communicates with the discharge port is formed in a vertical direction with respect to the linear flow channel of the discharge port. Accordingly, the communication hole is provided sideways at right angles to the flow direction of the oil in the flow channel of the discharge port.

The oil pump implements a pump operation in which oils is suctioned through an intake port and propelled out through a discharge port as the volume of a plurality of pump chambers within a casing thereof is continuously caused to fluctuate. As a result, pressure is generated in the oil that flows to the discharge port and a pulsing of the oil being propelled out occurs resulting in changes in the amplitude (pulsation) of the discharge pressure.

The pulsation of the oil in the discharge port is produced by pressure in the flow direction of the oil (dynamic pressure) and pressure in all directions in the discharge port (static pressure). The dynamic pressure, which constitutes the main cause of the pulsation, creates load on the devices and pipe members and so on through which oil from the oil pump is supplied and, in addition, as a result of the resonance thereof, leads to increased noise.

Absorption of pulsation due to dynamic pressure in the discharge port is hard to achieve in the oil chamber of Japanese Patent Application Laid-open No. 2005-146998 described above because direct introduction of the dynamic pressure in the flow direction of the oil into the oil chamber is difficult. The reason for this is because the oil chamber is provided sideways and in a juxtaposed arrangement with the discharge port, and the communication hole that affords communication between the discharge port and the oil chamber is provided at right angles to the flow direction of the oil of the flow channel of the discharge port.

Reduction of the static pressure pertaining to the pulsation of oil in the discharge port is possible by introduction by way of the communication hole of the dynamic pressure to the oil chamber provided in the lateral direction (side direction) of the flow channel of the discharge port. However, as the dynamic pressure is generated along the flow direction of the oil and the introduction thereof into the oil chamber in a direction other than the flow direction is difficult, in reality an essentially negligible reduction is achieved.

Accordingly, absorption of the dynamic pressure of pulsation is difficult in an oil chamber that communicates at right angles with respect to the flow direction of the oil in the flow channel of the discharge port and, as a result, achieving an adequate pulsation reduction is difficult.

Consequently, in conventional oil chambers an adequate effect in terms of reducing the pulsation due to dynamic pressure cannot be achieved, and reduction of the unwanted effects on other devices, and reduction of noise and so on, is difficult.

SUMMARY OF THE INVENTION

It is an object of the present invention to be able to adequately absorb the pulsation due to the dynamic pressure of the oil flow in the discharge flow channel so as to facilitate a reduction in pulsation and a reduction in unwanted effects on other devices, and a reduction in noise and so on.

An invention achieves the object described above by adoption of an oil pump that transports fluid from a suction port to a discharge port by the rotation of a rotor mounted in a pump casing in which a resonator configured from an introduction path and a chamber is formed with respect to a discharge flow channel that communicates with the discharge port in the flow direction of the discharge flow channel, a flow channel of a direction different to the flow direction of the discharge flow channel being communicatingly formed in the vicinity of the resonator.

An invention achieves the object described above by adoption of an oil pump that transports fluid from a suction port to a discharge port by the rotation of a rotor mounted in a pump casing in which an introduction path is formed in the flow direction of the discharge flow channel that communicates with the discharge port, an introduction opening of the introduction path is positioned substantially front with respect to the flow direction of the discharge fluid, a chamber that communicates with the discharge flow channel by way of the introduction path being formed, and a channel of a direction different to the flow direction of the discharge flow channel being communicatingly formed in the vicinity of the introducing path.

An invention achieves the object described above by adoption of an oil pump that transports fluid from a suction port to a discharge port by the rotation of a rotor mounted in a pump casing, comprising: a discharge flow channel that communicates with the discharge port; an introduction path formed in the flow direction of the discharge flow channel and formed so as to be positioned substantially front with respect to the flow direction; a chamber that communicates with the introduction path; and a flow channel that communicates with the discharge flow channel and is in a direction different to the flow direction of an end part of the discharge flow channel, the flow channel communicating with the discharge flow channel in the vicinity of the introduction path.

An invention achieves the object described above by adoption of an oil pump in which, in the configuration described above, the introduction path is provided in the same direction as the flow direction of the discharge flow channel. The invention achieves the object described above by adoption of an oil pump in which, in the configuration described above, the introduction path is formed narrower than the discharge flow channel.

The invention achieves the object described above by adoption of an oil pump in which, in the configuration described above, the inner diameter of the introduction path is formed to differ in a stepped form. The invention achieves the object described above by adoption of an oil pump in which, in the configuration described above, the introduction path is formed in a tapered shape.

The invention acheives the object described above by adoption of an oil pump in which, in the configuration described above, a plurality of chambers are formed in plurality and provided to communicate in series. The invention resolves the problems described above achieves the object described above by adoption of an oil pump in which, in the configuration described above, each of the plurality of chambers differs in volume. The invention achieves the object described above by adoption of an oil pump in which, in the configuration described above, the flow channel and the discharge flow channel are provided to communicate at a substantially right angle.

In the invention the hydraulic pulse of the fluid (oil) flowing along the flow channel can be adequately reduced by the formation in series of the resonator with respect to the discharge flow channel. In addition, in the invention, not only is the change in the magnitude of the pressure due to static pressure reduced, the introduction path is formed in series in the discharge flow channel, and the introduction opening of the introduction path opposes the flow direction of the fluid (oil). Furthermore, because the flow channel that communicates with the discharge flow channel is communicatingly formed in the vicinity of the introduction path and in a direction different to the flow direction of the discharge flow channel, the oil flowing along the discharge flow channel is caused to preferentially flow into the introduction opening opposing the flow direction.

Accordingly, the introduction path effectively introduces pulsation due to dynamic pressure of the oil flowing along the discharge flow channel into the chamber whereupon, as a result, vibration can be absorbed. As a result, an adequate reduction of hydraulic pulse of the oil that flows into the flow channel that communicates with the discharge flow channel can be achieved, and the effects on the devices to which the oil is supplied and through which it is circulated, and the noise and so on, can be reduced.

In the invention, by adoption of an oil pump in which an introduction path is formed in the same direction as the flow direction of the discharge flow channel, pulsation due to the dynamic pressure of the oil in the discharge flow channel can be even more effectively introduced into the chamber and, accordingly, o can be even better absorbed. In the invention, by formation of an introduction path narrower than the discharge flow channel, pulsation can be even better absorbed. More particularly, by matching the size of the introduction path to pulsation characteristics of the oil, the absorption effect of the chamber can be further improved and the function of the chamber with respect to the pulsation characteristics can be more adequately demonstrated.

In the invention, by adoption of an oil pump in which the inner diameter of the introduction path differs in a stepped form, the processing for forming the introduction path can be simplified. In the invention of claim 7, because the introduction path is formed in a tapered shape, turbulence of the oil introduced into the introduction path is unlikely to occur and the absorption of pulsation can be implemented smoothly.

In the invention as a result of the chamber being formed in plurality and the plurality of chambers being formed in series, the chamber volume can be enlarged and a better effect can be achieved. In the invention as a result of the plurality of chambers being each of a different volume, the chambers of respectively different volume are able to deal with the different pulsation frequencies of the various pulsations of varying frequencies (vibration) and, accordingly, the pulsation can be absorbed.

Next, in the invention, as result of the communication between the flow channel and the discharge flow channel at approximately right angles in the configuration described above, the introduction path and chambers can be easily arranged in a position front on to the flow direction of the oil and the structure of the pump can be simply and efficiently configured.

In addition, the oil flowing along the discharge flow channel is caused to flow preferentially into the introduction path opposing the flow direction and oil is prevented from flow into the flow channel prior to reaching the introduction path. Oil from which the chambers have adequately reduced the pulsation thereof can be caused to flow toward the flow channel. Accordingly, oil in a stable state can be caused to flow into the flow channel.

Furthermore, by forming the flow channel, which communicates in a direction at right angles with the discharge flow channel, into a circular-shaped hole, with the interior of this flow channel serving as the circumferential inside surface, flow of the oil in which the pulsation has been adequately reduced can be more uniformly stabilized and, in addition, flow resistance can be reduced. This circular-shaped hole can be easily formed using a rotary tool or the like.

DESCRIPTION OF THE PREFERRED EMBODIMENTS

Figure 1A:
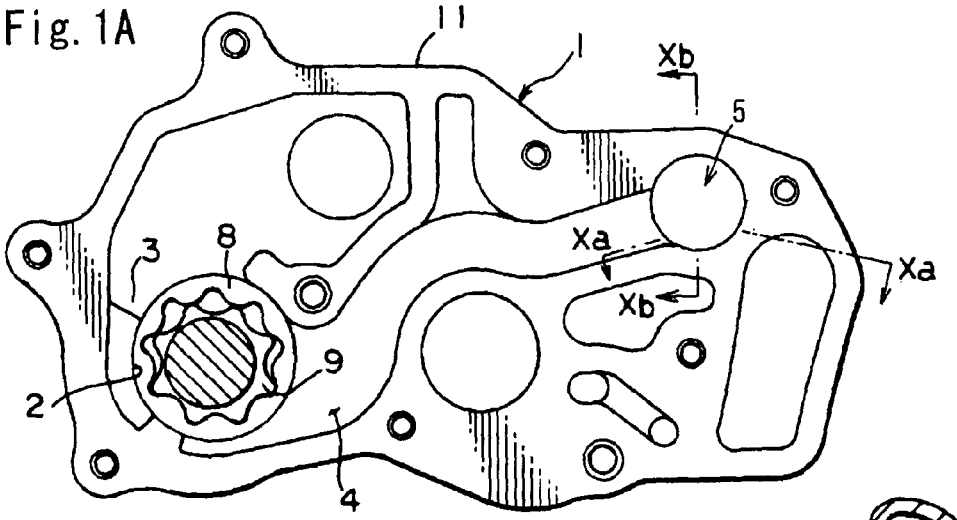
FIG. 1A is a plan view of a pump casing, B is a cross-sectional view along the line of the arrow Xa-Xa of A, and C is a cross-sectional view along the line of the arrow Xb-Xb of A.
Figure 6:
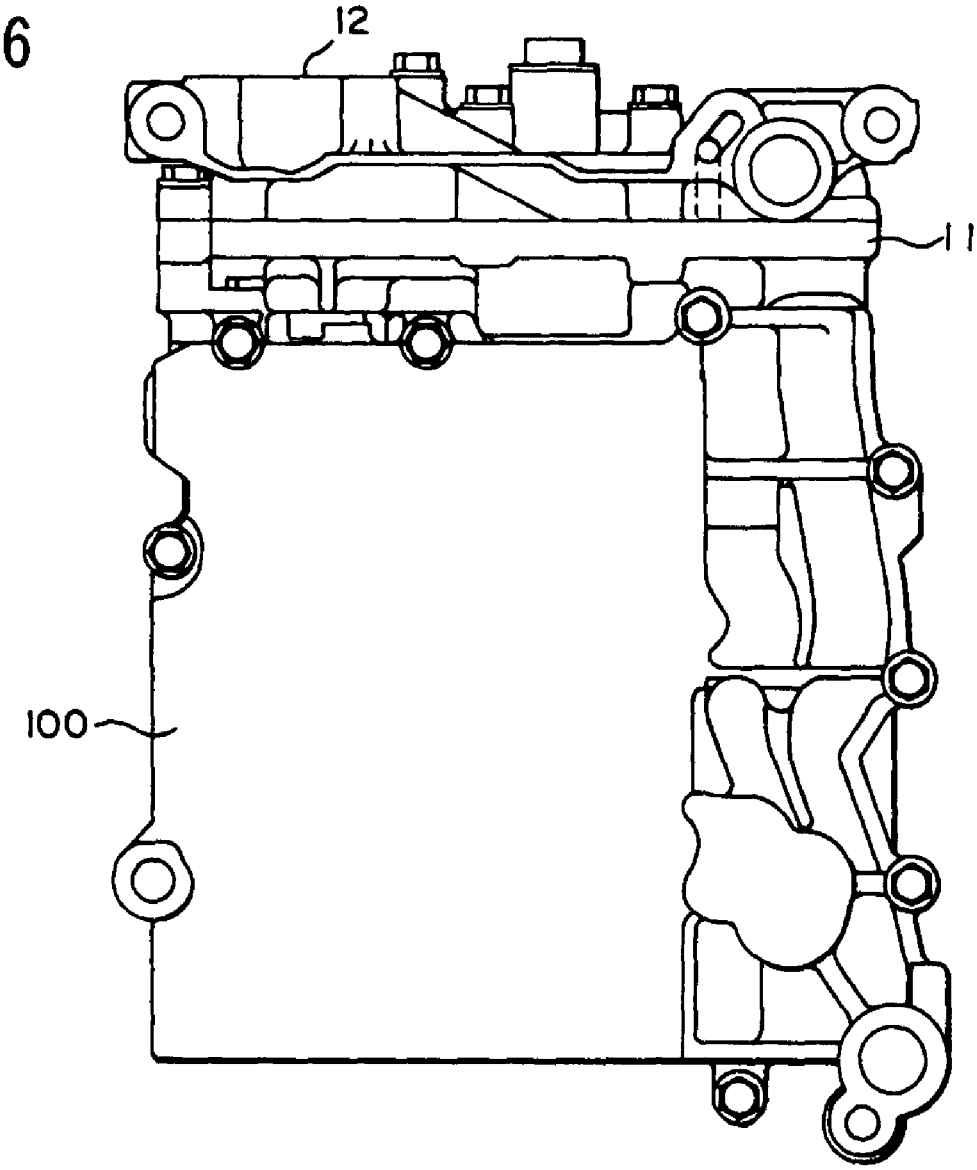
FIG. 6 is a side view of a pump casing and a balancer folder.

An embodiment of the present invention will be hereinafter described with reference to the diagrams. First, in the present invention, a pump casing 1 is configured from two pump bodies 11, 12 and joined by a fastening means such as a bolt and nut. As shown in FIG. 6, the pump casing 1 is integrally formed with a casing of a balancer folder 100. As shown in FIG. 1A, a rotor chamber 2, a suction port 3 and a discharge port 4 are formed in the interior of the pump casing 1.

A rotor is arranged in the rotor chamber 2. More specifically, the rotor is configured from a non-contacting type gear mechanism comprising two gear rotors. Hereinafter the present invention taken to be based on a torocoid pump in which the rotor is configured from a torocoid-toothed outer rotor 8 and inner rotor 9.

Figure 1B:
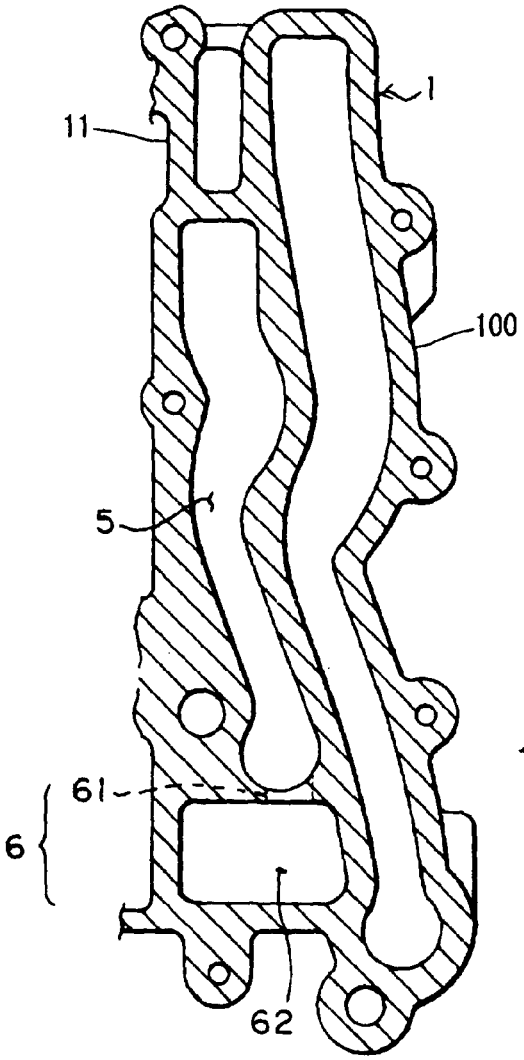

As shown in FIG. 1A, a discharge flow channel 5 is communicatingly formed with the discharge port 4. The discharge port 4 is formed to cross the interior of the pump casing 1, and the discharge channel 5 is formed in the casing of the balancer folder 100 so as to be essentially orthogonal to the plane in which the discharge port 4 is formed [see FIGS. 1B and C]. The role of the discharge flow channel 5 is to transport the oil discharged from the discharge port 4 into a later-described flow channel 7. The discharge flow channel 5 describes a linear pathway in the vicinity of a terminal part 5*a* thereof. The terminal part 5*a* constitutes an end part located in the opposite side to the end part that communicates with the discharge port 4.

Figure 2A:
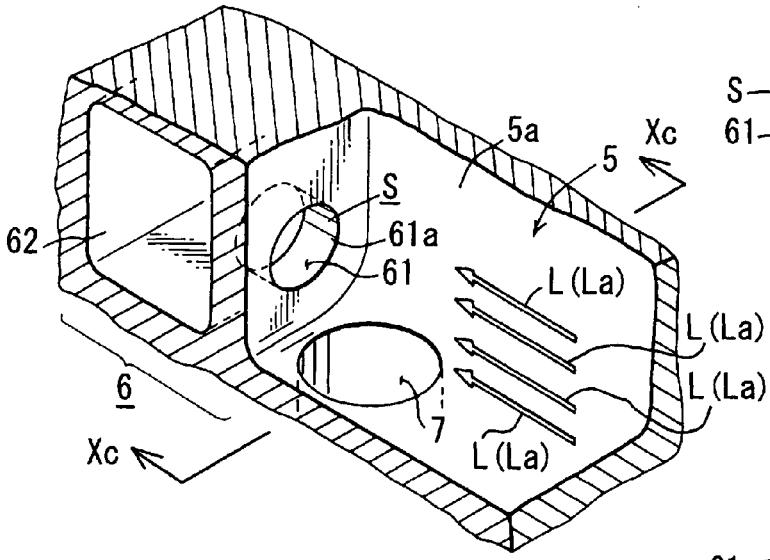
FIG. 2A is a partial cut-away perspective view of a discharge flow channel end part and a resonator, B is a partial cut-away vertical cross-sectional view of the discharge flow channel end part and the resonator; C is a cross-sectional view along the line of the arrow Xc-Xc of A; and D is a cross-sectional view along the line of the arrow Xd-Xd of B.
Figure 2C:
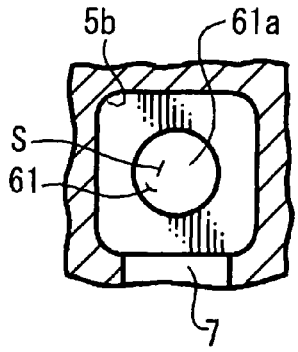
Figure 2D:
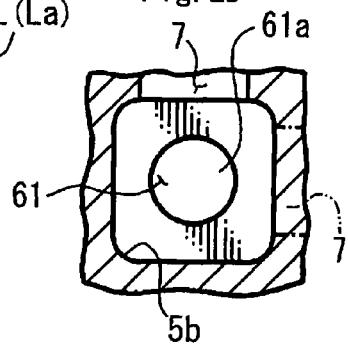
Figure 2B:
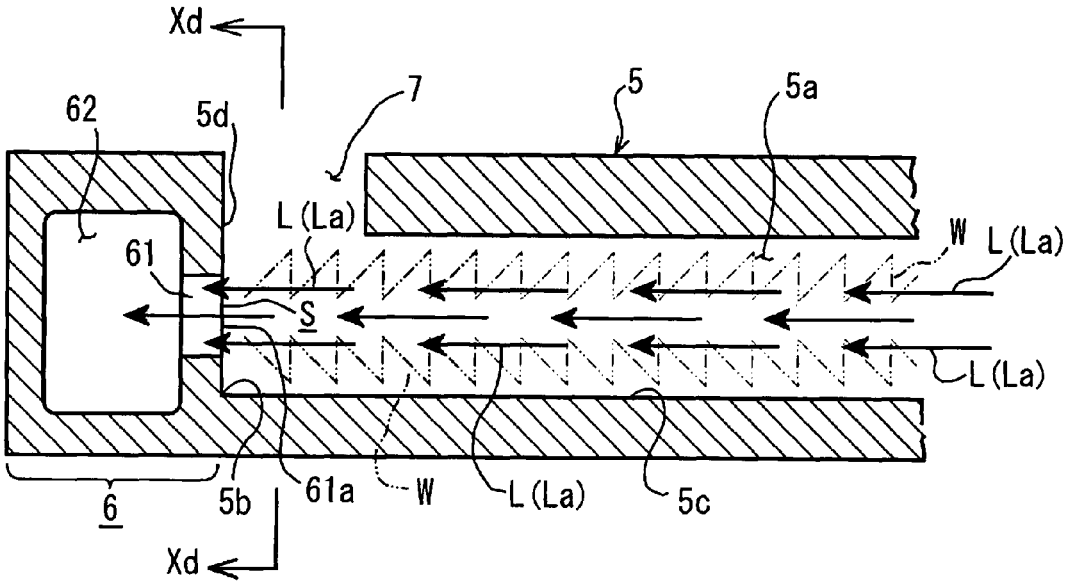

A resonator 6 is formed in series with respect to the terminal part 5*a* of the discharge flow channel 5. As shown in FIG. 2B, the series referred to here describes a position on an extended straight line of a flow direction L (flow line La) of the oil flowing along the discharge flow channel 5. As shown in FIG. 2, the resonator 6 is configured from an introduction path 61 and a chamber 62. The introduction path 61 constitutes a path of which the role thereof is to afford communication of the terminal part 5*a* of the discharge flow channel 5 with the chamber 62. The role of the chamber 62 is to reduce pulsation W of the oil flowing from the discharge port 4 along the discharge flow channel 5.

The introduction path 61 is formed in a pipe shape in the same direction as the flow direction of the discharge oil that flows through the interior from the terminal part 5*a* of the discharge flow channel 5. An introduction path 61 serves as a region affording communication between the terminal part 5*a* of the discharge flow channel 5 and the introduction opening 61*a* [see FIGS. 2A and B]. The shape of the introduction opening 61*a* matches the cross-sectional shape of the introduction path 61 and, more specifically, is circular in shape.

Figure 1C:
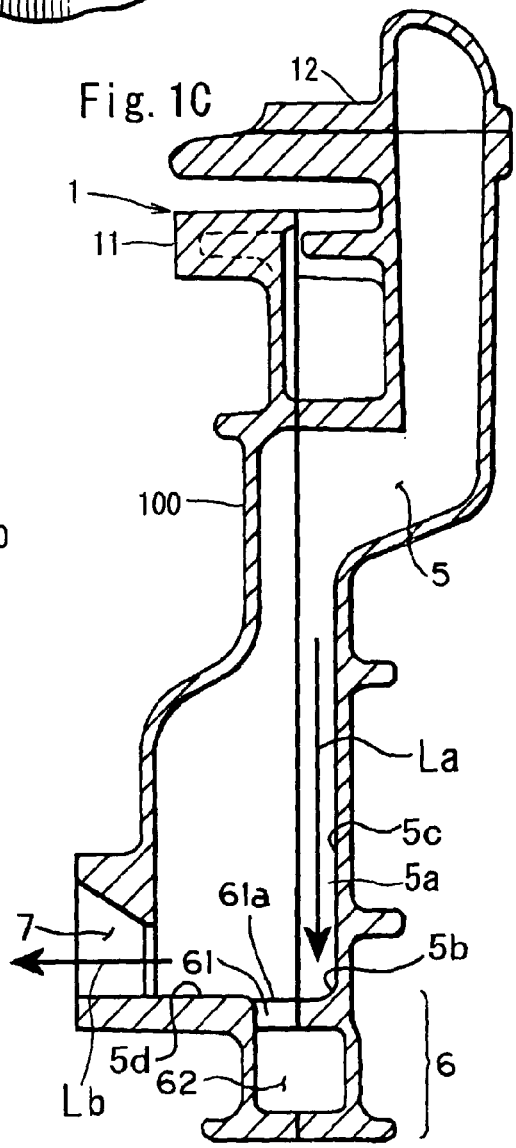

The flow line [see FIG. 1C] La that extends in a direction along an outer side wall 5*c* on the upstream side of a curved part 5*b* provided in the discharge flow channel 5 is taken as the flow direction. In addition, the flow line L toward the flow channel 7 altering in direction from the curved part 5*b* is taken as a downstream side flow line Lb. An introduction opening 61*a* of the introduction path 61 is positioned in a substantially front plane with respect to the flow direction of the discharge oil flowing along the terminal part 5*a* of the discharge flow channel 5. That is to say, assuming a level plane in which the introduction opening 61*a* is closed, as shown in FIG. 2B the assumed level plane S intersects at right angles (includes approximately right angles) with the flow line L in the flow direction of the discharge oil flowing along the terminal part 5*a*.

To put this another way, the terminal part 5*a* of the discharge flow channel 5 and introduction opening 61*a* are set so that the flow line L in the flow direction of the discharge oil flowing along the terminal part 5*a* of the discharge flow channel 5 intersects orthogonally with assumed level plane S of the introduction opening 61*a*. In addition, the setting is not restricted to the forming of a right angle between the flow line L and the assumed level plane S of the introduction opening 61*a*, and a setting in which the assumed level plane S describes a curved shape or is inclined with respect to the flow line L may be established as appropriate.

Because the introduction opening 61*a* of the introduction path 61 opposes the flow direction of the discharge oil flowing along the terminal part 5*a* of the discharge flow channel 5 in this way it need only be opened so that the discharge oil flows along the introduction path 61, and the opening shape thereof may be a flat shape, incline shape, arc shape or recessed shape or similar. The introduction opening 61*a* of the introduction path 61 receives the discharge oil flowing along the discharge flow channel 5 from directly in front and, as a result, the discharge oil can be effectively introduced into the chamber 62.

The pathway direction of the introduction path 61 describes a linear shape in the terminal part 5*a* of the discharge flow channel 5 in the same direction as the flow direction of the discharge oil. As a result, the discharge oil is introduced smoothly into the introduction path 61 from the terminal part 5*a* of the discharge flow channel 5. The pathway direction of the introduction path 61 may also describe a gentle arc shape [see FIG. 5B]. It is particularly preferable for the introduction path 61 to be formed in an arc shape in this way when there are restrictions to the area for the formation thereof due to the size and so on of the pump casing 1.

Figures 4A, 4B, 4C, 4D:
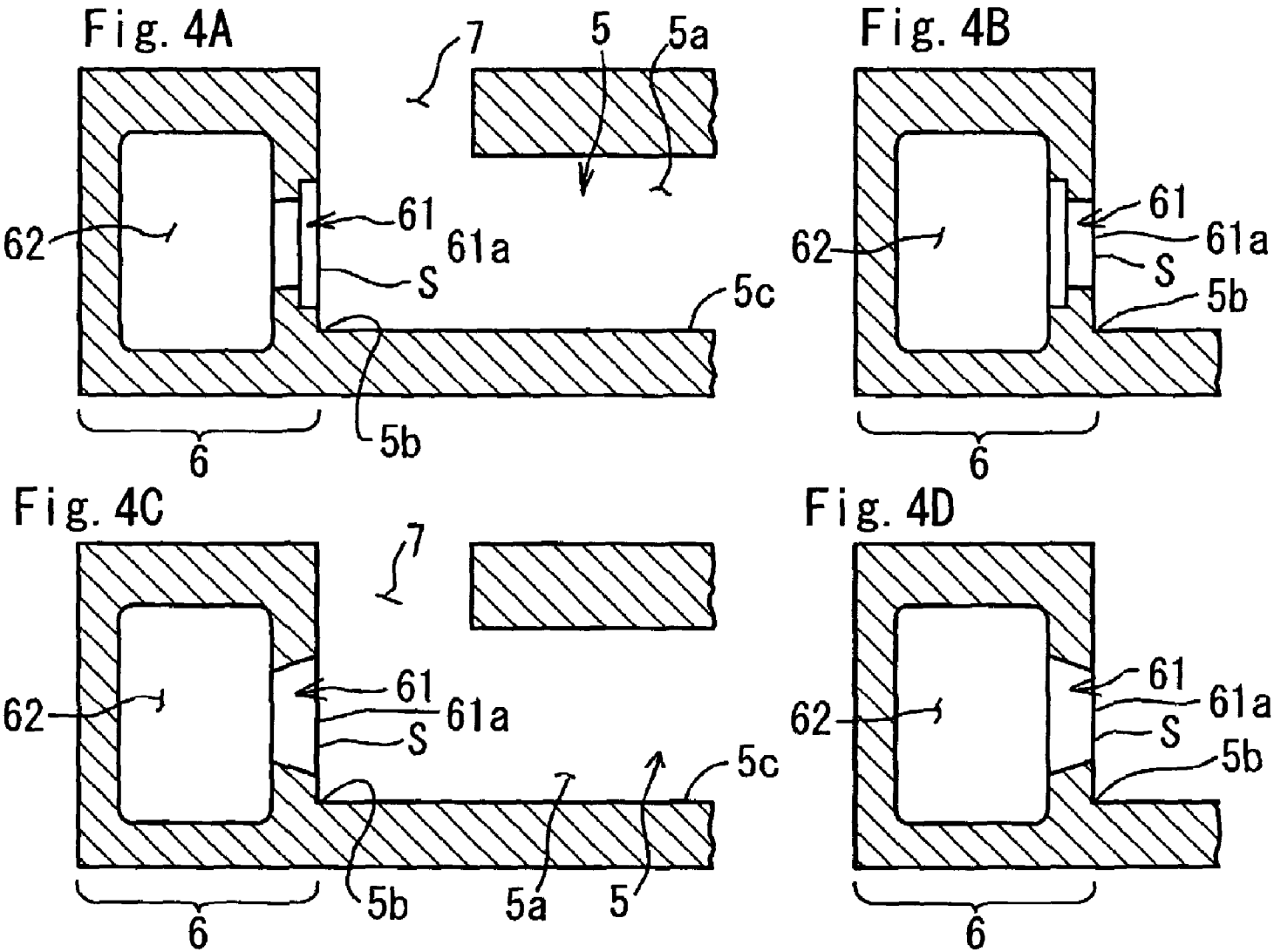
FIG. 4A is a cross-sectional view of an embodiment in which the inner diameter of the introduction path is formed in a stepped form narrowing toward the chamber, B is a cross-sectional view of an embodiment in which the inner diameter of the introduction path is formed in a stepped form widening toward the chamber, C is a cross-sectional view of an embodiment in which the inner side surface of the introduction path is formed in a taper narrowing gradually toward the chamber; and D is a cross-sectional view of an embodiment in which the inner side surface of the introduction path is formed in a taper widening gradually toward the chamber.

The introduction path 61 is formed with a cross-sectional area equivalent to that of the terminal part 5*a* of the discharge flow channel 5 or smaller than the terminal part 5*a*, and more preferably the introduction path 61 is formed to be thinner or narrower than the terminal part 5*a* and the chamber 62. Furthermore, as shown in FIGS. 4A and B, the inner diameter of the introduction path 61 is formed to differ in a stepped form being formed from a section of large cross-sectional area and a section of small cross-sectional area. The large cross-sectional area section of the introduction path 61 has a cross-sectional area equivalent to or smaller than that of the terminal part 5*a* of the discharge flow channel 5.

Furthermore, as shown in FIGS. 4C and D, the introduction path 61 may be formed in a tapered shape so with a gradually changing cross-sectional area size. While in each of these embodiments in which the introduction path 61 is formed in a stepped form and in which it is formed in a tapered shape the cross-sectional area decreases from the terminal part 5*a* of the discharge flow channel 5 toward the chamber 62, it may be conversely formed to increase in cross-sectional area. By adoption of a introduction path 61 of cross-sectional area no greater than that of the terminal part 5*a* of the discharge port 4 (sic) it serves the role of a diaphragm for the discharge oil with respect to the chamber 62.

Figures 5A, 5B:
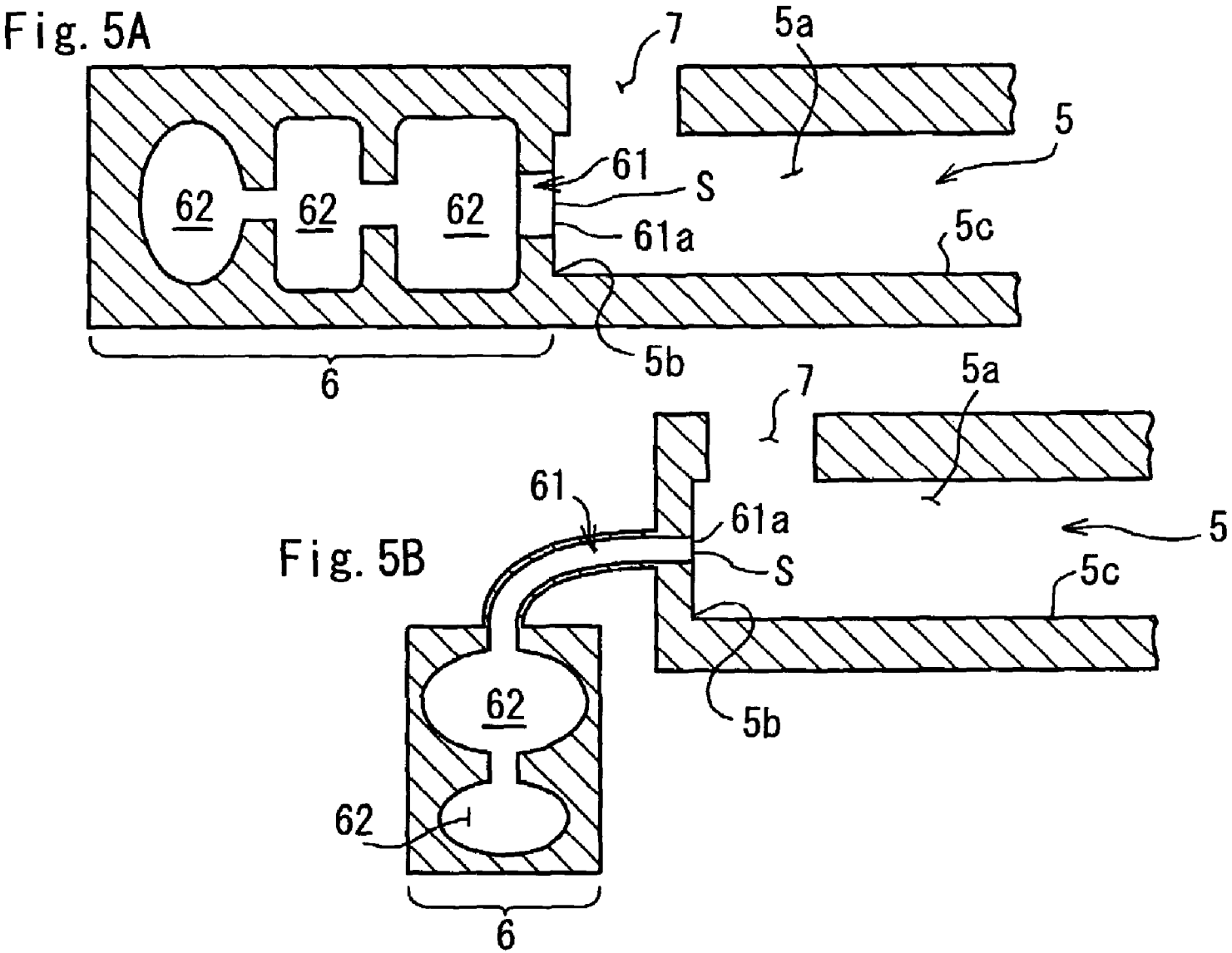
FIG. 5A is a cross-sectional view of resonator chambers configured in a plurality in series, and B is a cross-sectional view in which the introduction path is formed in an arc shape in the pathway direction.

The chamber 62 constitutes a gap chamber that is closed in positions apart from where there is communication with the introduction path 61. The shape of the introduction path 61 is set as appropriate so that the vibration of the pulsation W due to the dynamic pressure of the oil pump is effectively attenuated. As shown in FIG. 5A, the chambers 62 may be formed in a plurality and the plurality of chambers 62 may be formed in series, chambers 62 of a cubic or spherical shape being also possible. Furthermore, the chambers 62 may be formed to each be of different volume.

Next, the flow channel 7 communicates with the discharge flow channel 5 to perform a role of transporting the discharge oil flowing along the discharge flow channel 5 to the exterior of the pump casing 1. The flow channel 7 is positioned in the vicinity of the introduction path 61 and is communicatingly formed with the discharge flow channel 5. FIG. 2C is a cross-sectional view along the line of the arrow Xc-Xc of FIG. 2A which shows the position in which the flow channel 7 is formed. FIG. 2D is a cross-sectional view along the line of the arrow Xd-Xd of FIG. 2B which, different to FIG. 2A, constitutes an embodiment in which the flow channel 7 is formed in the wall face of the discharge flow channel 5, the flow channel 7 being formed in either the upward or horizontal directions.

In addition, the flow channel 7 is provided in the direction along an outer wall 5*d* of the downstream side of the curved part 5*b* provided in the discharge flow channel 5. Furthermore, the pathway direction of the flow channel 7 (flow direction) is formed in a direction different to the flow direction of the terminal part 5*a* of the discharge flow channel 5. More particularly, it is desirable that the discharge flow channel 5 and flow channel 7 communicate at an approximate right angle. The angle described by the formation of the discharge flow channel 5 and flow channel 7 may be inclined as appropriate. In addition, the flow channel 7 is formed in a position between the terminal part 5*a* of the discharge flow channel 5 and the introduction path 61 of the resonator 6, or in the discharge flow channel 5.

Figure 3A:
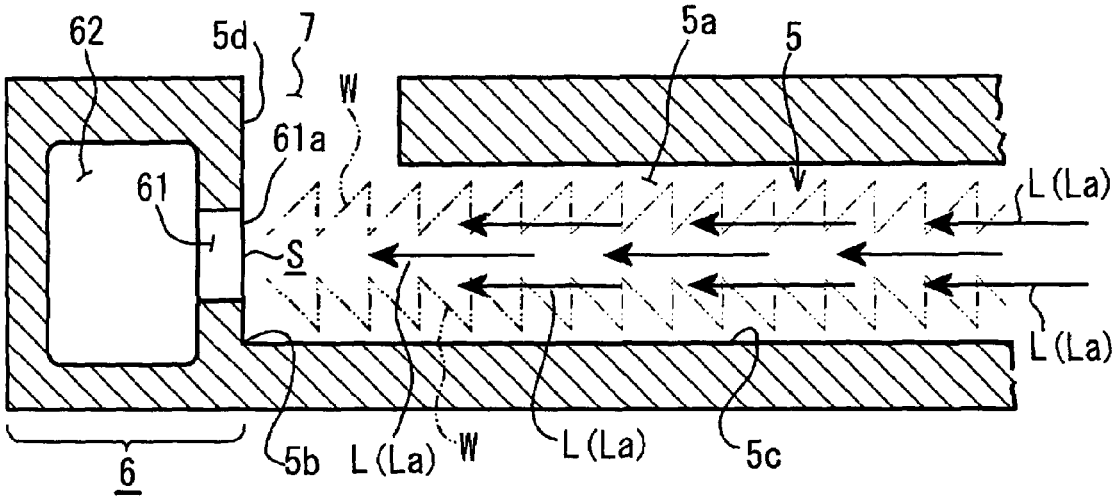
FIG. 3A to C are state diagrams showing the absorption action on pulsations afforded by the resonator.

The process by which the pulsation W of the discharge oil of the present invention is reduced will be explained with reference to FIG. 3. First, the discharge oil discharged from the discharge port 4 flows along the discharge flow channel 5, the discharge oil arriving at the resonator 6 arranged in series in the terminal part 5*a* of the discharge flow channel 5 [see FIG. 3A]. At this time the discharge oil has both a dynamic pressure and a static pressure that exerts pressure on the surroundings, an intermittent pulsation W being produced by the dynamic pressure in the flow direction of the discharge oil.

Figure 3B:
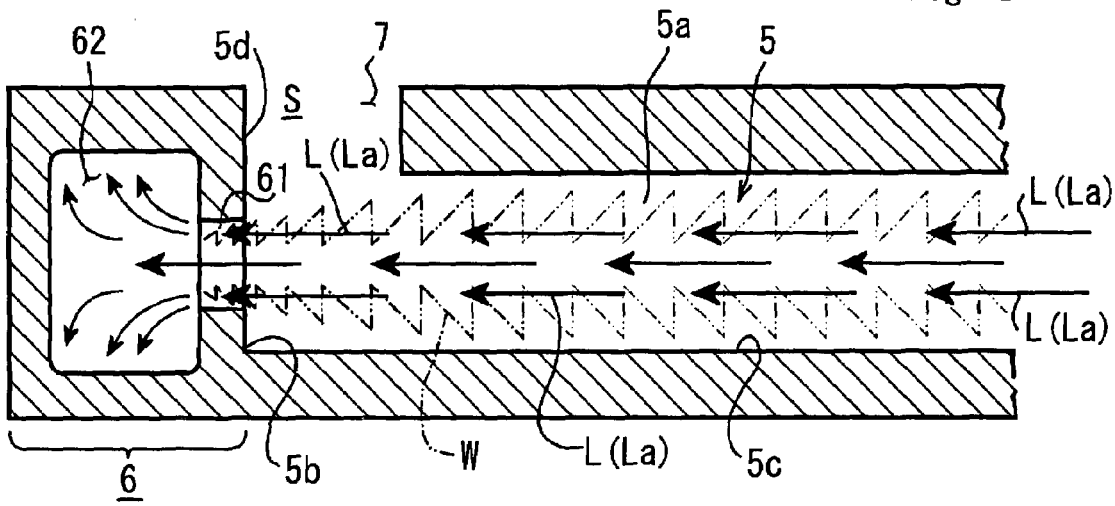

The introduction opening 61*a* of the introduction path 61 in the resonator 6 is provided opposing the flow direction of the discharge oil of the terminal part 5*a*, the discharge oil flowing into the introduction opening 61*a* and being introduced into the chamber 62 by way of the introduction path 61 [see FIG. 3B]. The discharge oil flows into the introduction path 61, the pulsation thereof being reduced as a result of its introduction into the chamber 62.

Figure 3C:
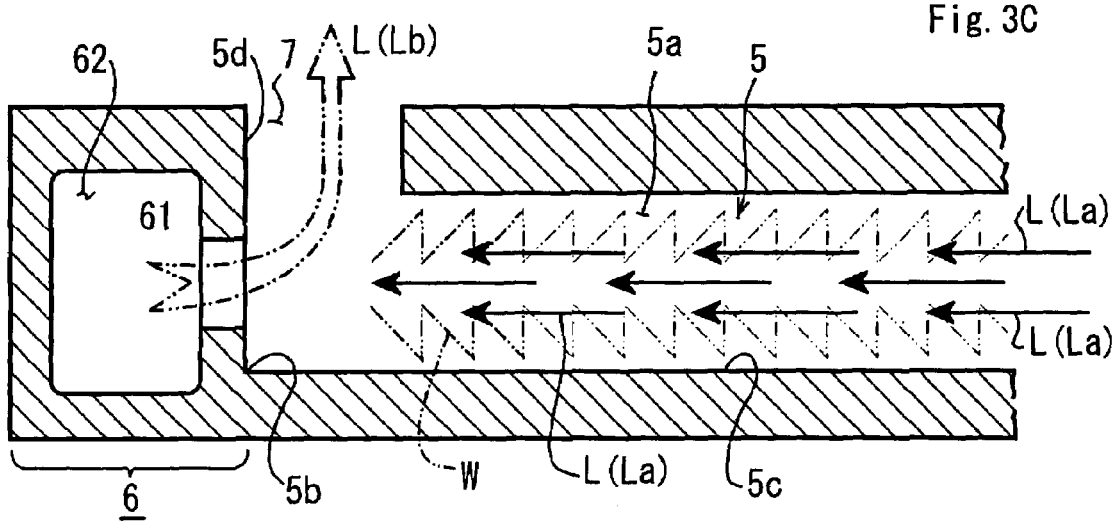

In this way, the discharge oil flows into the flow channel 7 in a state in which the pulsation of the discharge oil has been adequately reduced by the terminal part 5*a* of the discharge flow channel 5 and the resonator 6, whereupon the discharge oil is able to be transported to the exterior of the pump casing 1 in a stable state in which there is essentially no pulsation in the discharge oil of the flow channel 7 [see FIG. 3C].

Figure 7:
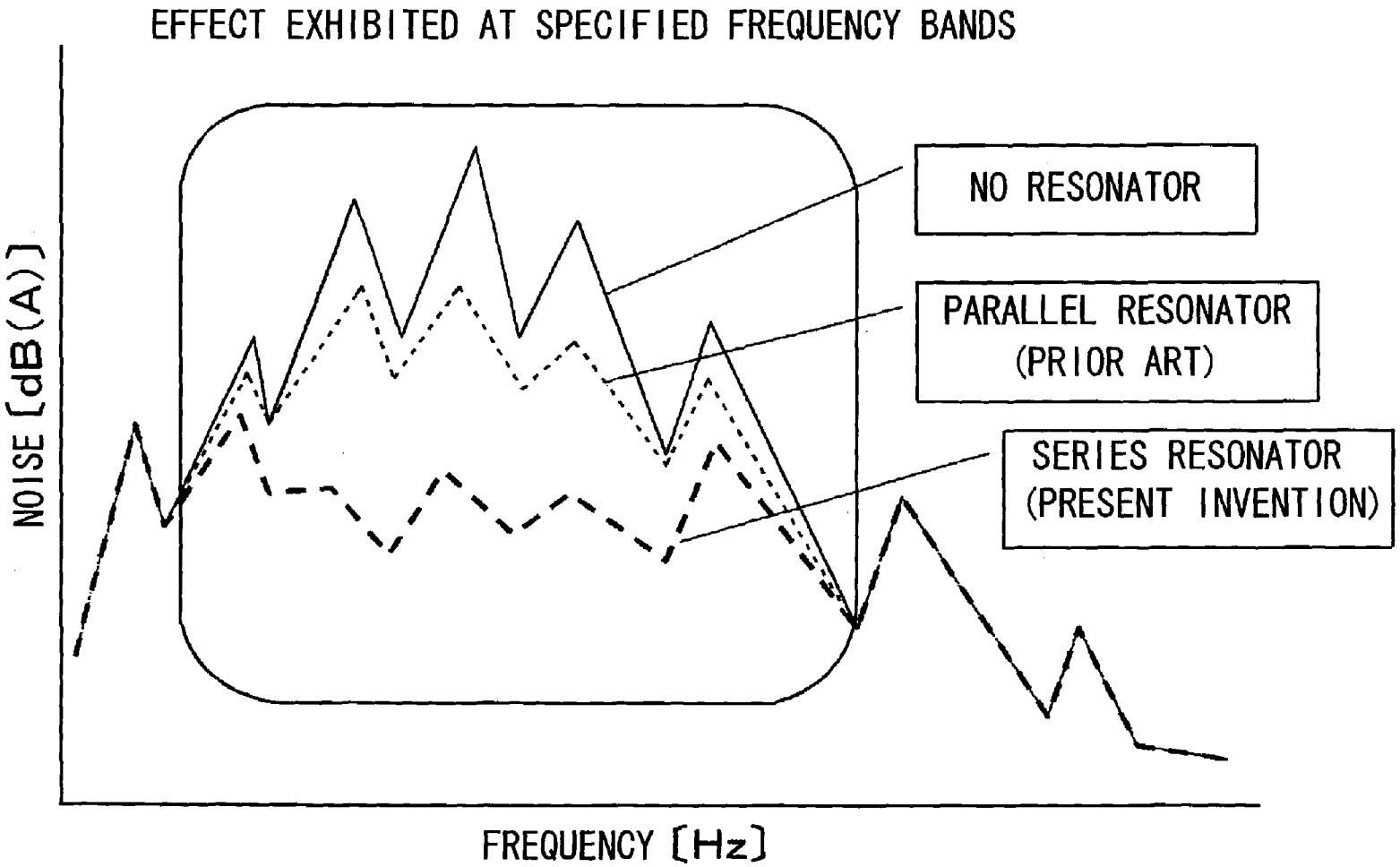
FIG. 7 is a graph showing the characteristics of the present invention.

FIG. 7 is a graph showing the characteristics of the present invention. The greatest level of noise is produced by a pump in which there is no resonator provided, the next loudest noise is exhibited by a conventional pump type in which resonators are juxtaposedly arranged. The oil pump of the present invention exhibits the least noise.

What is claimed is:

1. An oil pump that transports fluid from a suction port to a discharge port by rotation of a rotor mounted in a pump casing, comprising:

an introduction path being formed in the same direction as a flow direction of a discharge flow channel that communicates with the discharge port, the introduction path having a thickness which is less than a thickness of the discharge flow channel, an introduction opening of the introduction path being positioned substantially in front and substantially perpendicular with respect to the flow direction of the discharge fluid that extends in a direction along an outer side wall on an upstream side of a curved part provided in the discharge flow channel;

a chamber that communicates with the discharge flow channel by way of the introduction path being formed; and a channel being communicatingly formed, from the curved part, altering in a direction substantially perpendicular to the flow direction of the discharge flow channel.

2. The oil pump as claimed in claim 1, wherein an inner diameter of the introduction path comprises a stepped form.

3. The oil pump as claimed in claim 1, wherein the introduction path comprises a tapered shape.

4. The oil pump as claimed in claim 1, wherein the chamber comprises a plurality of chambers which communicate in series.

5. The oil pump as claimed in claim 4, wherein each of the plurality of chambers differ in volume.

* * * * *